US006082262A

United States Patent [19]

Kubitschek

[11] Patent Number: 6,082,262

[45] Date of Patent: Jul. 4, 2000

[54] INKING UNIT FOR ROTARY PRINTING PRESSES

[75] Inventor: Wolfgang Kubitschek, Wiesloch, Germany

[73] Assignee: Heidelberger Druckmaschinen Aktiengesellschaft, Heidelberg, Germany

[21] Appl. No.: 09/178,216

[22] Filed: Oct. 23, 1998

[30] Foreign Application Priority Data

Sep. 17, 1997 [DE] Germany ..... 197 40 841

[51] Int. Cl.[7] ..... B41F 35/00

[52] U.S. Cl. ..... 101/425; 101/424

[58] Field of Search ..... 101/423, 424, 101/425

[56] References Cited

U.S. PATENT DOCUMENTS 3,405,683 10/1968 Jons et al. ..... 101/425
4,474,111 10/1984 Holzhauser .
5,740,030 4/1998 Ottl et al. ..... 101/425

FOREIGN PATENT DOCUMENTS

0525586A1 2/1993 European Pat. Off. .
1133403 7/1962 Germany .
2299300A 10/1996 United Kingdom .

*Primary Examiner*—Ren Yan
*Attorney, Agent, or Firm*—Herbert L. Lerner; Laurence A. Greenberg; Werner H. Stemer

[57] ABSTRACT

In an inking unit for rotary printing presses, there is provided a cleaning device for cleaning inking rollers, including a distributor tube for supplying therethrough a given quantity of cleaning liquid, the distributor tube being disposed alongside the inking rollers, a plurality of outlet elbows via which the cleaning liquid is applicable to the inking rollers, and a drip pan disposed beneath the outlet elbows. The cleaning device further includes a suction tube formed with an opening for sucking in cleaning liquid collected in the drip pan, the suction tube being formed with another opening for applying, in a washing process, the cleaning liquid collected in the drip pan onto the rollers to be cleaned.

4 Claims, 1 Drawing Sheet

INKING UNIT FOR ROTARY PRINTING PRESSES

BACKGROUND OF THE INVENTION

Field of the Invention

The invention relates to an inking unit for rotary printing presses, with a cleaning device for cleaning inking rollers including a distributor roller disposed alongside the inking rollers for supplying therethrough a given quantity of cleaning liquid, a plurality of outlet elbows via which the cleaning liquid is applicable onto the inking rollers, and a drip pan disposed beneath the outlet elbows.

In modern high-speed rotary printing presses, the cleaning of inking rollers is performed automatically and program-controlled, so that the cleaning process takes place in the shortest possible time. The cleaning cycles are performed manually or program-controlled, so that for a multicolor press only brief interruptions in the printing process are necessary. Inasmuch as a multiplicity of outlet elbows are provided for supplying the cleaning liquid, in the case of a multicolor printing press, the danger of subsequent dripping arises, which would lead to disruptions. A drip pan under the outlet elbows reliably prevents penetration by cleaning liquid into the inking unit during the printing process, and consequent disruptions. When automatically operating the rotary printing press, and when using cleaning media having low vaporization, small quantities of dripped-off cleaning liquid accumulate in the drip pans and must be removed.

A device for cleaning ink-feeding rollers has become known heretofore from the published German Patent Document DE 31 28 928 C2, wherein an aerating tube is assigned to a distributor tube in order to achieve a no-load operation of the distributor tube. Subsequent dripping of the cleaning liquid is thereby supposed to be prevented.

In this heretofore known device, the distributor tube must be filled with cleaning liquid for each cleaning operation, which requires a given amount of time. The required quantity of cleaning liquid is consequently determinable only with great difficulty. Moreover, drops of cleaning liquid may remain suspended both on the supply tubes and on the aerating tubes, and can penetrate into the inking unit at an indeterminate time and can cause disruptions therein.

In a further construction in accordance with German Patent 197 112 545, a device for emptying a drip pan has been disclosed which requires a construction expenditure which must match or be adjusted to the respective press configuration.

SUMMARY OF THE INVENTION

Starting from this state of the prior art, it is accordingly an object of the invention of the instant application to provide an inking unit for rotary printing presses with a cleaning device without very great additional construction outlay, the cleaning device being optionally installable in the printing unit of a rotary printing press and reliably prevents cleaning liquid from penetrating into the inking unit during the operation of the press.

With the foregoing and other objects in view, there is provided, in accordance with the invention, in an inking unit for rotary printing presses, a cleaning device for cleaning inking rollers, including a distributor tube for supplying therethrough a given quantity of cleaning liquid, the distributor tube being disposed alongside the inking rollers, a plurality of outlet elbows via which the cleaning liquid is applicable to the inking rollers, and a drip pan disposed beneath the outlet elbows, comprising a suction tube formed with an opening for sucking in cleaning liquid collected in the drip pan, the suction tube being formed with another opening for applying, in a washing process, the cleaning liquid collected in the drip pan onto the rollers to be cleaned.

In accordance with another feature of the invention, the suction tube is assigned to a suction pump.

In accordance with a further feature of the invention, the suction pump is formed as an injector in the suction tube, and is secured to a blast air supply line.

In accordance with a concomitant feature of the invention, the injector in the suction tube has a blast tube blowing in a direction towards an outlet opening of the suction tube.

By the foregoing construction, the small quantity of cleaning liquid present in the drip pan is able to be sucked away for each washing operation and fed to the cleaning cycle, in a relatively simple manner, so that the drip pan need not be emptied manually. Servicing of the printing press, especially a multicolor press, is thereby considerably facilitated. The suction device can be triggered simultaneously with the actuation of the cleaning device, so that also, from a control-engineering standpoint, no additional program flows are required.

In an advantageous realization of the invention, a suction pump is assigned to the suction tube, any type of suction pump with very low output being suitable therefor. This device is thereby able to be produced at very low cost.

In an advantageous embodiment of the invention, the suction pump is formed as an injector in the suction tube and is fastened to the suction tube. With this construction, adequate pumping action is able to be produced at low expenditure. In this regard, the blast tube of the injector is directed in the suction tube towards the outlet opening thereof.

Other features which are considered as characteristic for the invention are set forth in the appended claims.

Although the invention is illustrated and described herein as embodied in an inking unit for rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
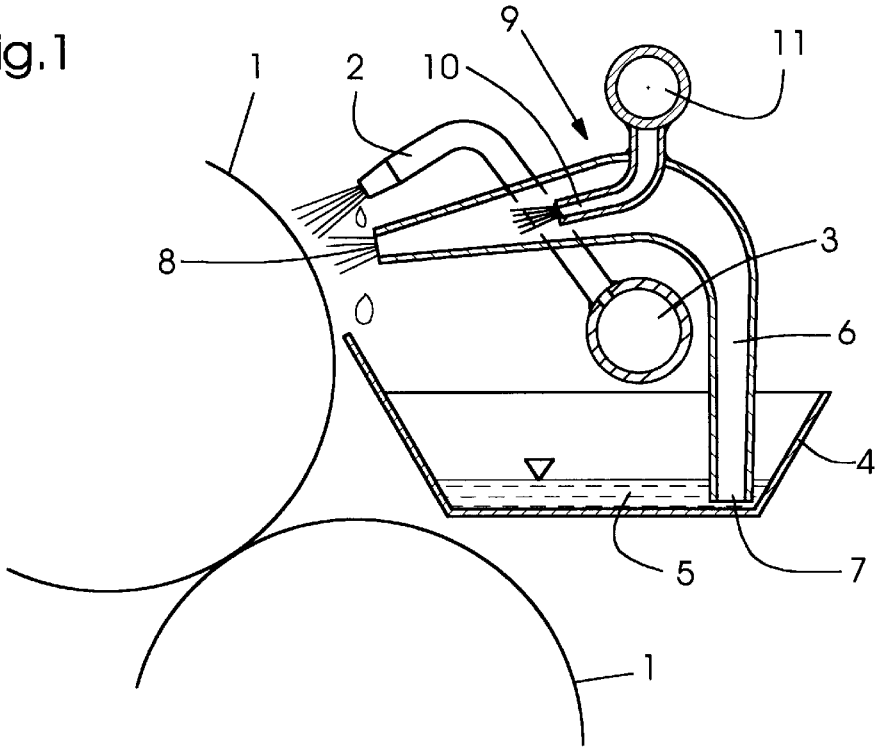
FIG. 1 is a fragmentary diagrammatic side elevational view of inking rollers of an inking unit and a partly cross-sectional view of a cleaning device according to the invention.
Figure 2:
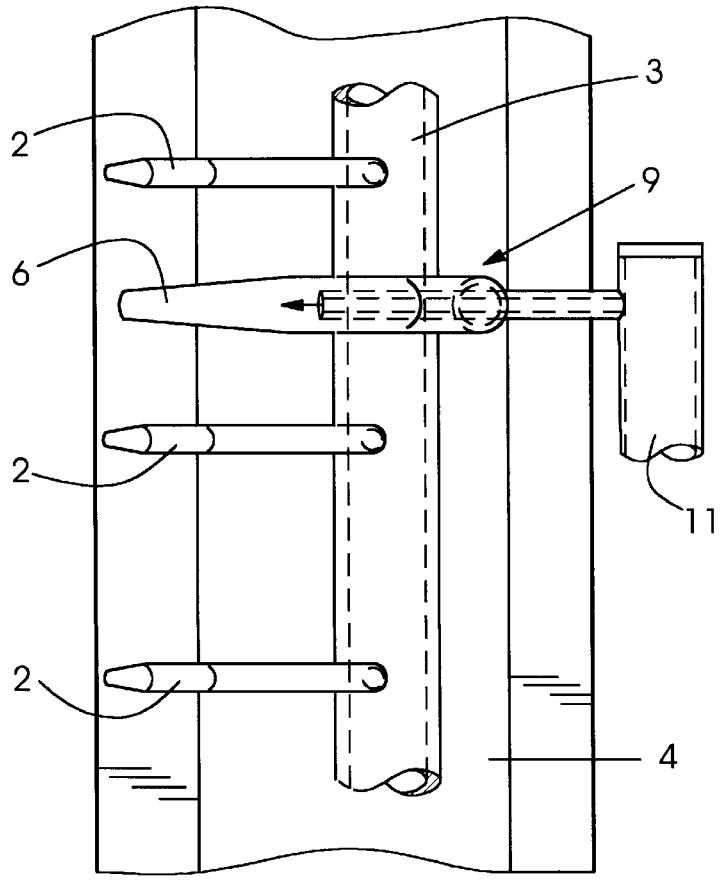
FIG. 2 a fragmentary plan view of FIG. 1 showing the cleaning device.

Referring now to the figures of the drawing, there are shown therein inking rollers 1 of an inking unit of a rotary printing press, transporting ink on the jacket surfaces thereof for inking a printing plate. The jacket surfaces of the inking rollers 1 must be cleaned at given time intervals in order to remove dirt particles and dried-on ink residues, which can cause disruptions and impairment when the printing plate is inked. Cleaning of the inking rollers 1 occurs in the illustrated example of FIGS. 1 and 2 by applying cleaning liquid via outlet elbows 2 to the jacket surfaces of the inking rollers 1. A multiplicity of the outlet elbows 2 are disposed along a respective inking roller 1, in this regard, and are secured to a distributor roller 3 through which cleaning liquid is able to be supplied. Beneath the outlet elbows 3, a drip pan 4 is provided, which collects dripping cleaning liquid 5 therein after the cleaning process has been performed. A small amount of the cleaning liquid 5 can collect in the drip pan 4, depending upon the type of cleaning liquid that is used and upon the time sequence of the cleaning cycles.

According to the invention, a suction tube 6 is provided, which has an opening 7 at one end thereof which is dipped into the cleaning liquid 5 accumulated in the drip pan 4. In contrast with the opening 7 for sucking in the cleaning liquid 5, the suction tube 6 is formed with an outlet opening 8 at the other end thereof, through which the sucked-in or aspirated cleaning liquid 5 is applied during the washing operation to the inking rollers 1 to be cleaned. In accordance with an advantageous embodiment of the invention, an injector 9 is provided in the suction tube 6 and has a blow or blast tube 10 blowing in a direction towards the outlet opening 8. The injector 9 and, accordingly, the suction tube 6 are secured to a blast air supply line 11. Such an injector 9 can be provided, as a suction pump or several thereof, over the length of the inking rollers 1 to be cleaned. The accumulated cleaning liquid 5 in the drip pan 4 is thereby able to be aspirated or sucked-in at each cleaning operation, so that servicing personnel do not have to perform any manual emptying of the drip pan 4.

I claim:

1. In an inking unit for rotary printing presses, a cleaning device for cleaning inking rollers, including a distributor tube for supplying therethrough a given quantity of cleaning liquid, the distributor tube being disposed alongside the inking rollers, a plurality of outlet elbows via which the cleaning liquid is applicable to the inking rollers, and a drip pan disposed beneath the outlet elbows, comprising:

a suction tube formed with an opening for sucking in cleaning liquid collected in the drip pan, a suction device disposed outside of the cleaning liquid in the drip pan for supplying suction power to said suction tube, said suction tube being formed with another opening for applying, in a washing process, the cleaning liquid collected in the drip pan onto the rollers to be cleaned, thereby reusing any cleaning liquid collected in the drip pan and, therefore, requiring no emptying of the drip pan.

2. The cleaning device according to claim 1, said suction device including a suction pump connected to said suction tube.

3. The cleaning device according to claim 2, including a blast air supply line wherein said suction pump is formed as an injector in said suction tube, and is secured to said blast air supply line.

4. The cleaning device according to claim 3, wherein said injector in said suction tube has a blast tube blowing in a direction towards an outlet opening of said suction tube.

* * * * *